United States Patent [19]

Takahashi et al.

[11] Patent Number: 4,869,154

[45] **Date of Patent: * Sep. 26, 1989**

[54] WOBBLE PLATE TYPE COMPRESSOR WITH A DRIVE SHAFT ATTACHED TO A CAM ROTOR AT AN INCLINATION ANGLE

[75] Inventors: Hareo Takahashi, Takasaki; Kiyoshi Terauchi, Isesaki; Hideharu Hatakeyama, Isesaki; Shuzo Kumagai, Isesaki, all of Japan

[73] Assignee: Sanden Corporation, Gunma, Japan

[ * ] Notice: The portion of the term of this patent subsequent to Oct. 3, 2006 has been disclaimed.

[21] Appl. No.: 142,712

[22] Filed: Jan. 11, 1988

[30] Foreign Application Priority Data

Jan. 10, 1987 [JP] Japan ..... 57-2632

[51] Int. Cl.[4] ..... F04B 1/26

[52] U.S. Cl. ..... 92/71; 417/269

[58] Field of Search ..... 92/71; 417/269; 91/507; 74/60

[56] References Cited

U.S. PATENT DOCUMENTS

| | | | |
|---|---|---|---|
| 3,552,886 | 1/1971 | Olson, Jr. | 417/269 |
| 3,712,759 | 1/1973 | Olson, Jr. | 417/269 |
| 4,042,309 | 8/1977 | Hiraga | 417/269 |
| 4,061,443 | 12/1977 | Black et al. | 74/60 X |
| 4,073,603 | 2/1978 | Abendschein et al. | 417/269 X |
| 4,149,830 | 4/1979 | Woodruff | 74/60 X |
| 4,283,997 | 8/1981 | Takahashi et al. | 417/269 X |
| 4,290,345 | 9/1981 | Hiraga et al. | 417/269 X |
| 4,301,716 | 11/1981 | Saegusa et al. | 92/71 |
| 4,351,227 | 9/1982 | Copp, Jr. et al. | 92/71 |
| 4,594,055 | 6/1986 | Hatakeyama et al. | 417/269 |
| 4,664,604 | 5/1987 | Terauchi | 417/222 |

*Primary Examiner*—William L. Freeh

*Attorney, Agent, or Firm*—Banner, Birch, McKie & Beckett

[57] ABSTRACT

A wobble plate type compressor which includes a compressor housing having a plurality of cylinders and a crank chamber adjacent the cylinders is disclosed. A reciprocative piston is slidably fitted within each of the cylinders. A drive mechanism is coupled to the pistons. The drive mechanism includes a drive shaft which is rotatably supported in an opening of a front end plate and extends into the compressor housing. The drive shaft is supported by a radial bearing. The drive shaft is attached to an end surface of a cam rotor at an inclination angle $\theta_1$ and rotates therewith. The angle $\theta_1$ is predetermined so that under severe operating conditions the interior surface of the radial bearing and the exterior surface of the drive shaft uniformly contact each other to prevent damage due to partial contact. Also, an urging mechanism causes the inner end surface of the cam rotor to uniformly contact a thrust bearing disposed between the cam rotor and the front end plate.

3 Claims, 4 Drawing Sheets

WOBBLE PLATE TYPE COMPRESSOR WITH A DRIVE SHAFT ATTACHED TO A CAM ROTOR AT AN INCLINATION ANGLE

TECHNICAL FIELD

This invention relates to a wobble plate type compressor for use in an automotive air conditioning system, and more particularly, to an improved cantilever structure for supporting the drive shaft within the compressor housing.

BACKGROUND OF THE INVENTION

The use of a cantilever structure for supporting the drive shaft in a wobble plate type compressor is well known. For example, this structure is disclosed in U.S. Pat. Nos. 3,552,886 and 3,712,759.

FIG. 1 shows a conventional refrigerant compressor for use, for example, in an automotive air conditioning system. Wobble plate type compressor 1 has a conventional cantilever structure and includes cylindrical compressor housing 2 with front end plate 3 and a rear end plate at opposite ends thereof. The rear end plate is in the form of cylindrical head 4. Cylinder block 21 is located within compressor housing 2 and crank chamber 22 is formed between the interior surface of compressor housing 2, cylinder block 21, and the interior surface of front end plate 3. Valve plate 5 covers the combined exterior surfaces of compressor housing 2 and cylinder block 21, and cylinder head 4 is attached to compressor housing 2 via bolt 41 extending through valve plate 5. Front end plate 3 includes opening 31 through a central portion thereof and through which drive shaft 6 extends into crank chamber 22.

Drive shaft 6 is rotatably supported within opening 31 of front end plate 3 by radial needle bearing 7. Wedge-shaped cam rotor 8 is fixedly coupled to the end of drive shaft 6 within crank chamber 22. Cam rotor 8 is also supported on the interior surface of front end plate 3 by thrust needle bearing 9. Drive shaft 6 and cam rotor 8 rotate in unison.

Wobble plate 10 is annular and is provided with bevel gear 101 at its central portion. Wobble plate 10 is disposed on inclined surface 81 of cam rotor 8 and is supported by thrust needle bearing 16 therebetween. Supporting member 11 includes shank portion 112 disposed within central bore 211 of cylinder block 21, and bevel gear 111 which engages bevel gear 101 of wobble plate 10. Shank portion 112 includes hollow portion 113. Support member 11 nutatably supports wobble plate 10 with spherical element 12 (e.g., a steel ball) disposed between bevel gear 101 and bevel gear 111. A key is located between cylinder block 21 and supporting member 11 to prevent rotational motion of supporting member 11. Adjusting screw 17 is disposed within central bore 211 adjacent the end of shank portion 112. Coil spring 13 is disposed within hollow portion 113 and urges supporting member 11 toward wobble plate 10. The engagement of bevel gear 111 with bevel gear 101 prevents the rotation of wobble plate 10.

A plurality of cylinders 212 are uniformly spaced around the periphery of cylinder block 21. Pistons 14 are slidably fitted within each cylinder 212. Connecting rods 15 connect each piston 14 to the periphery of wobble plate 10 via ball joints. Discharge chamber 42 is centrally formed within cylinder head 4, and suction chamber 43 has an annular shape and is located within the periphery of cylinder head 4 around discharge chamber 42. Suction holes 51 are formed through valve plate 5 to link suction chamber 43 with each cylinder 212 and discharge holes 52 are formed through valve plate 5 to link each cylinder 212 with discharge chamber 42.

A driving source rotates drive shaft 6 and cam rotor 8 via electromagnetic clutch 18 mounted on tubular extension 35 of front end plate 3. Wobble plate 10 nutates without rotating in accordance with the rotational movement of cam rotor 8, and each piston 14 reciprocates within cylinders 212. The recoil strength of coil spring 13 may be adjusted by rotating adjusting screw 17 to securely maintain the relative axial spacing between thrust bearing 9, cam rotor 8, wobble plate 10, bevel gear 101, spherical element 12, and supporting member 11. However, the relevant spacing may change when compressor 1 is operated due to dimensional error in the machining of the elements and due to changing temperature conditions within crank chamber 22.

Wobble plate type compressor 1 is normally used as a refrigerant compressor in an automotive air conditioning system and should be sufficiently durable under normal operating conditions which include periods of operation under severe conditions. However, under severe operating conditions, such as driving for a long period of time in high temperatures, sometimes the driving parts of the compressor may fail to operate as desired, decreasing the durability of the compressor and causing it to malfunction. It has been determined that compressor malfunction is caused by fragmentation of bits of the exterior surface of drive shaft 6 where it contacts the interior surface of radial needle bearing 7. The fragments damage the other driving parts of the compressor, thereby causing it to malfunction.

FIG. 2 is developmental view showing the exterior surface of drive shaft 6 within radial bearing 7. (The cylindrical surface has been "unwrapped" and laid flat.) Drive shaft 6 rotates around the center of radial bearing 7 as it rotates or spins around its own longitudinal axis so that the contact surface of drive shaft 6 with radial bearing 7 does not vary. Strong contact and thus fragmentation occurs at area A. Area B indicates additional locations where contact occurs between drive shaft 6 and radial bearing 7. The contact at area B is not as strong so it is not damaged, but area B has a lustered or shined surface due to the contact. It can be seen that the exterior surface of drive shaft 6 does not uniformly and fully contact the interior surface of radial bearing 7. Fragmentation results from this non-uniform contact between the exterior surface of drive shaft 6 and the interior surface of radial bearing 7.

FIG. 3 shows the forces acting on cam rotor 8 and drive shaft 6 during operation of the compressor. The external forces acting on cam rotor 8 include a gross gas compression force $F_1$ acting axially at point A due to the compression of each piston 14. Point A is located near the connection of connecting rod 15 with wobble plate 10 via the ball joint. The gross gas compression force acts when each piston is at its top dead center point, which occurs when the thicker part of cam rotor 8 is adjacent each piston 14. The gross gas compression force acts on inclined surface 81 of cam rotor 8 and therefore includes radial component $F_3$. Additionally, axially urging force $F_2$ acts on cam rotor 8 at a central location. The axially urging force is created due to the recoil strength of coil spring 13 acting cam rotor 8 via intermediate elements. The urging force also acts on inclined surface 81 of cam rotor 8 and therefore includes radial component $F_4$.

Axial reaction force $F_5$ is created at the contact point, point B, between cam rotor 8 and thrust bearing 9 and balances the axial forces $F_1$ and $F_2$. However, no reaction force is available to balance the combined force provided by the radial component forces $F_3$ and $F_4$ and thus, the radial component forces create a torque causing cam rotor 8 to shift around point B within the plane of FIG. 3. As a result, cam rotor 8 is separated from thrust bearing 9 at the side adjacent each piston 14 at its bottom dead center point which occurs when the thinner part of cam rotor 8 is adjacent each piston 14. Therefore, the rotational axis of drive shaft 6 is inclined with respect to the longitudinal axis of radial bearing 7, and contact occurs between drive shaft 6 and radial bearing 7 and points C and D. The angle of inclination $\theta$ between drive shaft 6 and radial bearing 7 depends upon the axial length of radial bearing 7 and the clearance in the radial direction between the interior surface of radial bearing 7 and the exterior surface of drive shaft 6.

Radial reaction forces $F_6$ and $F_7$ act on drive shaft 6 from radial bearing 7 in opposite directions at points C and D respectively. Since there is no movement of drive shaft 6 in the radial direction during operation, these forces balance the radial component forces $F_3$ and $F_4$ as follows:

$$F_3+F_4=F_6-F_7$$

Since after cam rotor 8 contacts thrust bearing 9 there is no further rotation around point B, the moment around point B is represented by the following equation:

$$F_3l_1+F_4l_2+F_6l_3-F_1(r_2-r_1)-F_2r_2-F_7l_4=0$$

where $l_1$, $l_2$, $l_3$, and $l_4$ are displacements measured in the axial direction and $r_1$ and $r_2$ are displacements measured in the radial direction between each force vector and point B. Each addend is the magnitude of the cross product of the two vectors. However, only one non-zero component remains after the cross product since the force and displacement vectors are perpendicular. $F_5$ is not represented since it acts at point B.

The magnitude of radial reaction forces $F_6$ and $F_7$ is dependent upon the angle of inclination $\theta$, which is itself dependent upon the axial component of the gross gas pressure. The inclination angle $\theta$ is predetermined to be within a range between 0 and 0.04 degrees when a standard clearance is provided between drive shaft 6 and radial bearing 7. Therefore, the operation of the compressor under a high thermal load causes fragmentation of drive shaft 6 due to the magnitude of the radial reaction forces which create non-uniform contact with radial bearing 7.

SUMMARY OF THE INVENTION

It is a primary object of the present invention to provide a wobble plate type compressor which prevents the occurrence of non-uniform contact between the drive shaft and the radial bearing under severe operating conditions, for example, when the air conditioning is operated under a high thermal load.

It is another object of the present invention to increase the durability of the compressor when operated under severe operating conditions for an extended period of time.

These and other objects are achieved in a wobble plate type compressor according to the present invention which includes a compressor housing having a plurality of cylinders and an adjacent crank chamber therein. A reciprocable piston is slidably fitted within each of the cylinders, and is coupled to a wobble plate. A drive mechanism includes a drive shaft which is rotatably supported within a front end plate attached to the compressor housing and which extends within the crank chamber. The drive shaft is supported by a radial bearing with the front end plate and a wedge-shaped cam rotor is attached to the end of the drive shaft. The cam rotor is rotatably supported on an inner end surface of the compressor housing through a thrust needle bearing. The drive shaft and the cam rotor rotate in unison causing the wobble plate to nutate, reciprocating the pistons within each of their cylinders. The wobble plate is coupled to an urging mechanism. The drive shaft is attached to the cam rotor at a predetermined angle of inclination. This angle of inclination is between the longitudinal axis of the drive shaft and an axis perpendicular to the vertical rear surface of the cam rotor. There is also a predetermined angle between the longitudinal axis of the drive shaft and the longitudinal axis of the radial bearing. The angle of inclination is selected so that under extreme operating conditions, when a large gross gas compression force acts, the longitudinal axis of the drive shaft rotates to be parallel to the longitudinal axis of the radial bearing to create uniform contact between the radial bearing and the drive shaft due to the external forces acting on the cam rotor. Also, the force of the urging mechanism on the wobble plate causes the inner end surface of the cam rotor to uniformly contact the thrust needle bearing to reduce wear of the cam rotor.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
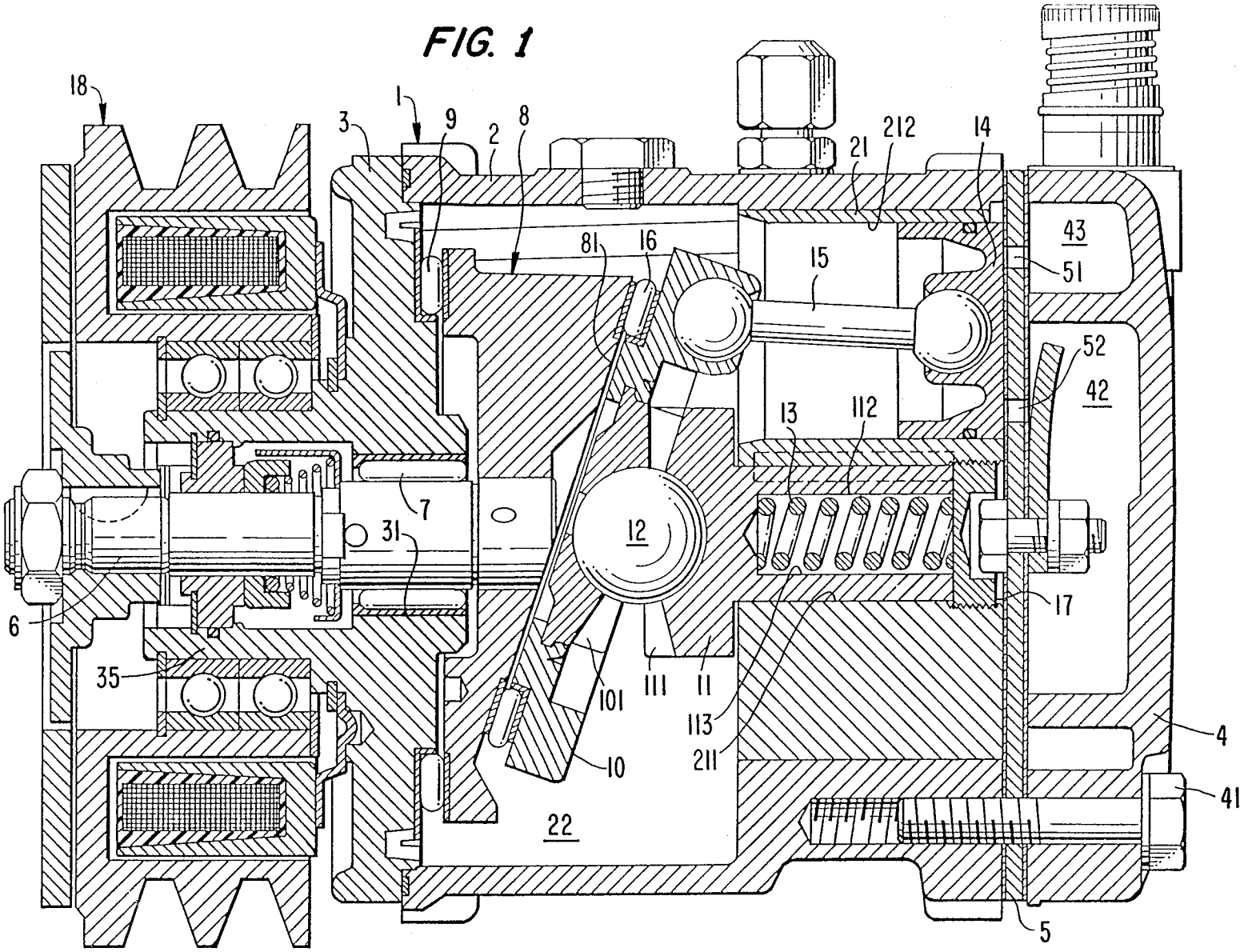
FIG. 1 is a cross-sectional view of a conventional wobble plate type compressor.
Figure 2:
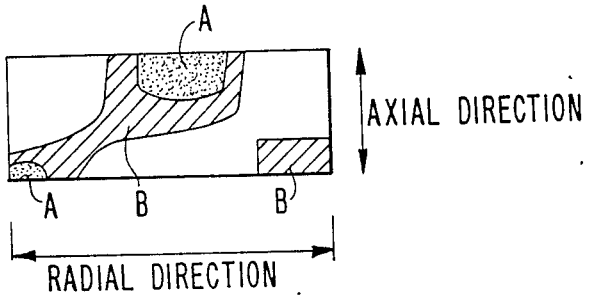
FIG. 2 is a developmental view of the exterior surface of the drive shaft shown in FIG. 1.
Figure 3:
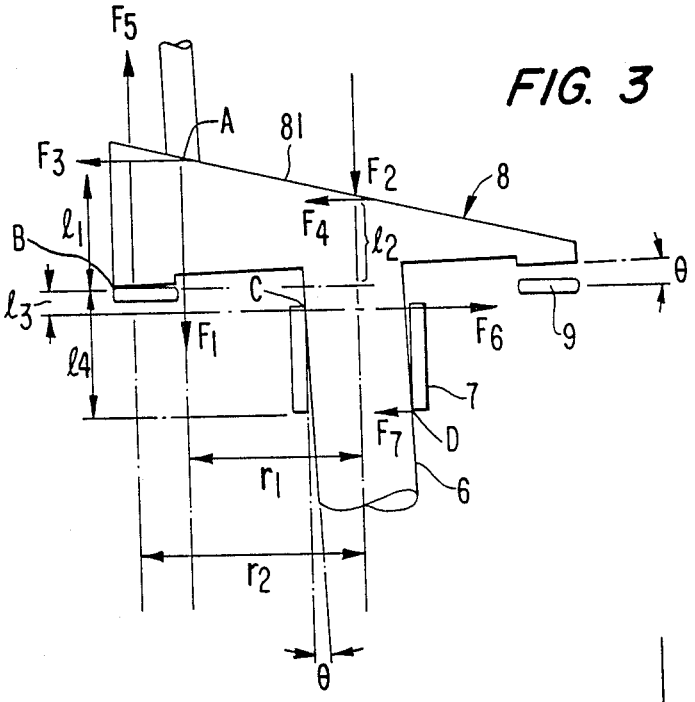
FIG. 3 is a view showing the relationship between the forces acting on the cam rotor and the drive shaft of the compressor of FIG. 1.
Figure 4:
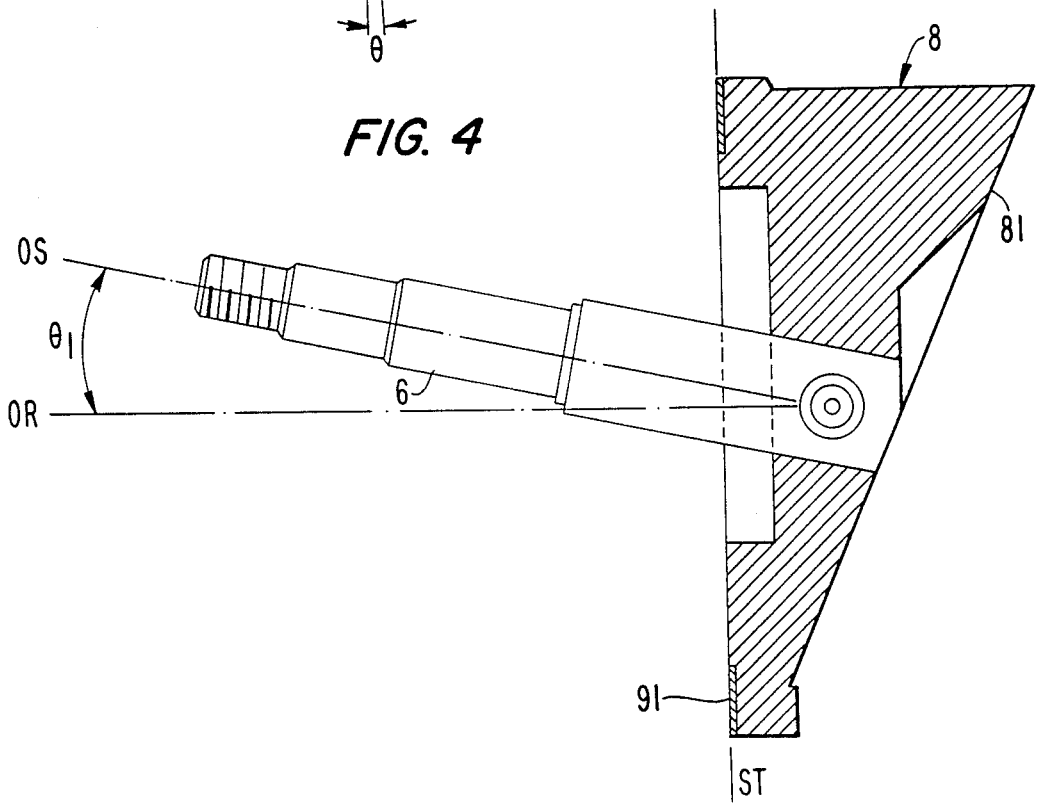
FIG. 4 is a cross-sectional view of part of a wobble plate type compressor according to the present invention showing the assembly of the cam rotor and the drive shaft.

FIG. 4 shows the construction of a drive shaft and a wedge-shaped cam rotor in accordance with one embodiment of the invention. This drive shaft and cam rotor configuration may be used in the compressor of FIG. 1. Cam rotor 8 has a wedge-shaped cross section and an annular vertical outer end surface facing end plate 3 defined by line ST. In a conventional compressor, the longitudinal axis of drive shaft 6, indicated as OR, is perpendicular to line ST. However, in the present invention, drive shaft 6 is assembled with cam rotor 8 so that the longitudinal axis of drive shaft 6, indicated as OS, forms an angle $\theta_1$ with perpendicular axis OR. Axis OS is not perpendicular to line ST and drive shaft 6 is inclined toward piston 14 at its top dead center point, that is, toward the thicker part of cam rotor 8. The magnitude of angle $\theta_1$ is determined by the following equation:

$$\theta_1 \geqq \tan^{-1}(c/l)$$

where c is the clearance between the interior surface of radial bearing 7 and the exterior surface of drive shaft 6 and l is the axial length of radial bearing 7.

Figure 5:
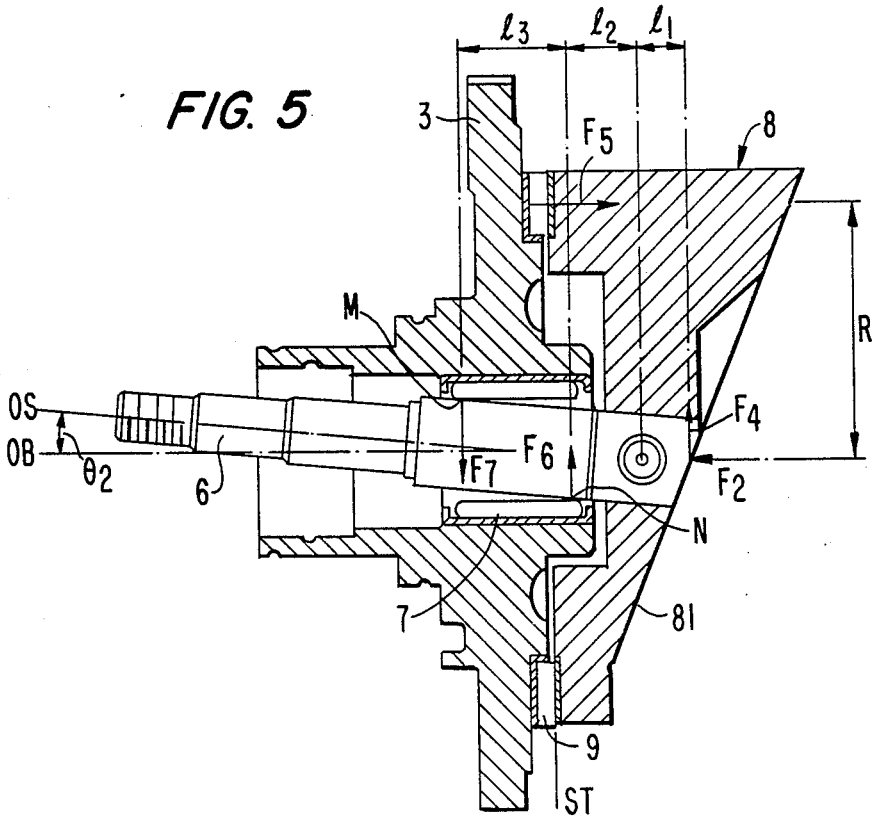
FIG. 5 is a cross-sectional view of part of the wobble plate type compressor of FIG. 4 including the front end plate, the drive shaft, the cam rotor, and the radial bearing.

FIG. 5 shows the assembly of cam rotor 8, front end plate 3 and drive shaft 6 in a nonoperative situation. Drive shaft 6 extends through central opening 31 and is supported by radial bearing 7. As explained with reference to FIG. 1, the recoil strength coil spring 13 may be adjusted by adjusting screw 17. The axial urging force $F_2$, which includes the recoil strength of spring 13, is adjusted to a predetermined value exceeding the forces at the connecting point of drive shaft 6 and cam rotor 8. This rotates the left end of drive shaft 6 downwardly to permit the axial end surface of cam rotor 8 to uniformly contact thrust bearing 9. In this configuration, the outer surface of drive shaft 6 contacts the inner surface of radial bearing 7 at points M and N. Angle $\theta_2$ between axis OS of drive shaft 6 and axis OB of radial bearing 7 is determined by the following equation:

$$\theta_2 = \tan^{-1}(c/l)$$

Longitudinal axis OS of drive shaft 6 is shifted by an angle $\phi$ degrees when the compressor is as shown in FIG. 5. $\phi$ is equal to $\theta_1 - \theta_2$. If the strength coefficient of the connecting portion of cam rotor 8 and drive shaft 6 is expressed as a constant k, then the right-rotational moment Ms is equivalent to $k\phi$ and must act on drive shaft 6 due to changing the angle between drive shaft 6 and cam rotor 8 to provide uniform contact between drive shaft 6 and the upper interior surface of radial bearing 7.

Under these conditions the balance between the forces acting on the elements of the compressor can be represented by the following equations:

$$F_4 + F_6 = F_7$$

$$F_2 = F_5$$

$$F_5R + F_6l_2 - F_4l_1 - F_7(l_2 + l_3) = 0$$

$$Ms = k\phi = F_7(l_2 + l_3) - F_6l_2$$

where $l_1$, $l_2$, $l_3$, and R are the dimensions shown in FIG. 5, and $F_2$, $F_4$, $F_5$, $F_6$, $F_7$ are the forces shown acting on the elements of the compressor. $F_5$ is the reaction force of thrust bearing 9 and $F_6$ and $F_7$ are the reaction forces of radial bearing 7.

The first two equations represents the lack of translation motion of the elements after drive shaft 6 is assembled in front end plate 3 and adjusting screw 13 is varied to contact rotor 8 with bearing 9. The third equation represents the lack of rotational movement in the plane of the paper around the point of connection between drive shaft 6 and cam rotor 8. The fourth equation represents the balance between the moment provided by the reaction forces $F_6$ and $F_7$ from radial bearing 7 on drive shaft 6 to the restoration force $k\phi$.

Figure 6:
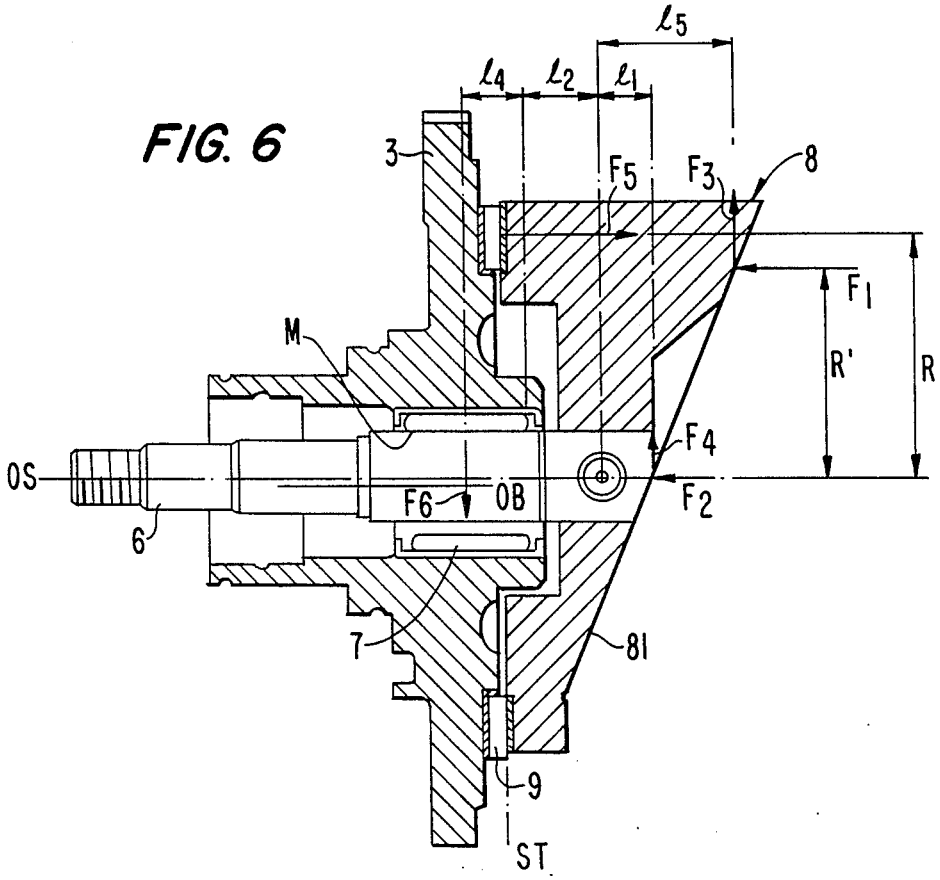
FIG. 6 is a cross-sectional view of part of the compressor of in FIG. 5 showing the effect of external forces acting on the compressor during operation.

FIG. 6 shows the external forces acting on the compressor during operation: the gross gas compression force $F_1$, the axial urging force $F_2$, and the radial component forces $F_3$ and $F_4$, all of which act on inclined surface 81 of cam rotor 8. The radial component forces $F_3$ and $F_4$ cause cam rotor 8 to rotate in the counterclockwise direction so that the thicker side moves toward front end plate 3 so that plate 91 contacts bearing 9 at the top side. Rotation of cam rotor 8 causes drive shaft 6 to rotate around point M toward the bottom dead center side. Point M is located at the outer end of the interior surface of radial bearing 7. As a result, longitudinal axis OS of drive shaft 6 becomes parallel to longitudinal axis OB of radial bearing 7. Drive shaft 6 is therefore supported on the upper interior surface of radial bearing 7.

During operation of the compressor under the above conditions, the balance between the forces acting on the elements of the compressor can be represented by the following equations:

$$F_3 + F_4 = F_6$$

$$F_1 + F_2 = F_5$$

$$F_5R - F_4l_1 - F_1R' - F_6(l_2 + l_4) = 0$$

$$Ms = k\phi = F_6(l_2 + l_4)$$

where $l_1$, $l_2$, $l_3$, R, and R' are the dimensions shown in FIG. 6, and $F_1$, $F_2$, $F_3$, and $F_4$ are the forces shown acting on the elements of the compressor. $F_5$ is the reaction force of thrust bearing 9, and $F_6$ and $F_7$ are the reaction forces of radial bearing 7. Ms is a right rotational moment acting on drive shaft 6 due to changing the angle between drive shaft 6 and cam rotor 8. $\phi$ is $\theta_1 - \theta_2$.

The first two of the above equations represent the balance that is maintained between the forces acting on the compressor elements since the elements do not undergo translational motion. The third equation represents the balance of the rotational forces that is maintained after normal operating conditions are reached. Each addend in the equation represents the cross-product of a force vector with a displacement vector. The cross-products are simplified since $l_1$, $l_2$, $l_3$, $l_4$, $l_5$, and R and R' are the perpendicular components of the displacement vector associated with each force. The sum of the cross-products equals zero since when the compressor operates, after the initial rotation of cam rotor 8 and drive shaft 6 around point M, no further rotation around point M occurs. Finally, the fourth equation represents the balance between the moment provided by the reaction force $F_6$ on drive shaft 6 to balance the restoration force $k\phi$ created when drive shaft 6 rotates through angle $\phi$, i.e., to balance the restoring force.

As a net result of the forces, the upper exterior surface of drive shaft 6 uniformly contacts the upper interior surface of radial bearing 7 to prevent fragmentation of the surface of drive shaft 6. Furthermore, since forces $F_1$ and $F_2$ urge the axial end surface of cam rotor 8 toward thrust bearing 9, the axial end surface of cam rotor 8 uniformly contacts thrust bearing 9. Therefore, tearing of the surface of cam rotor 8 is also prevented.

Figure 7:
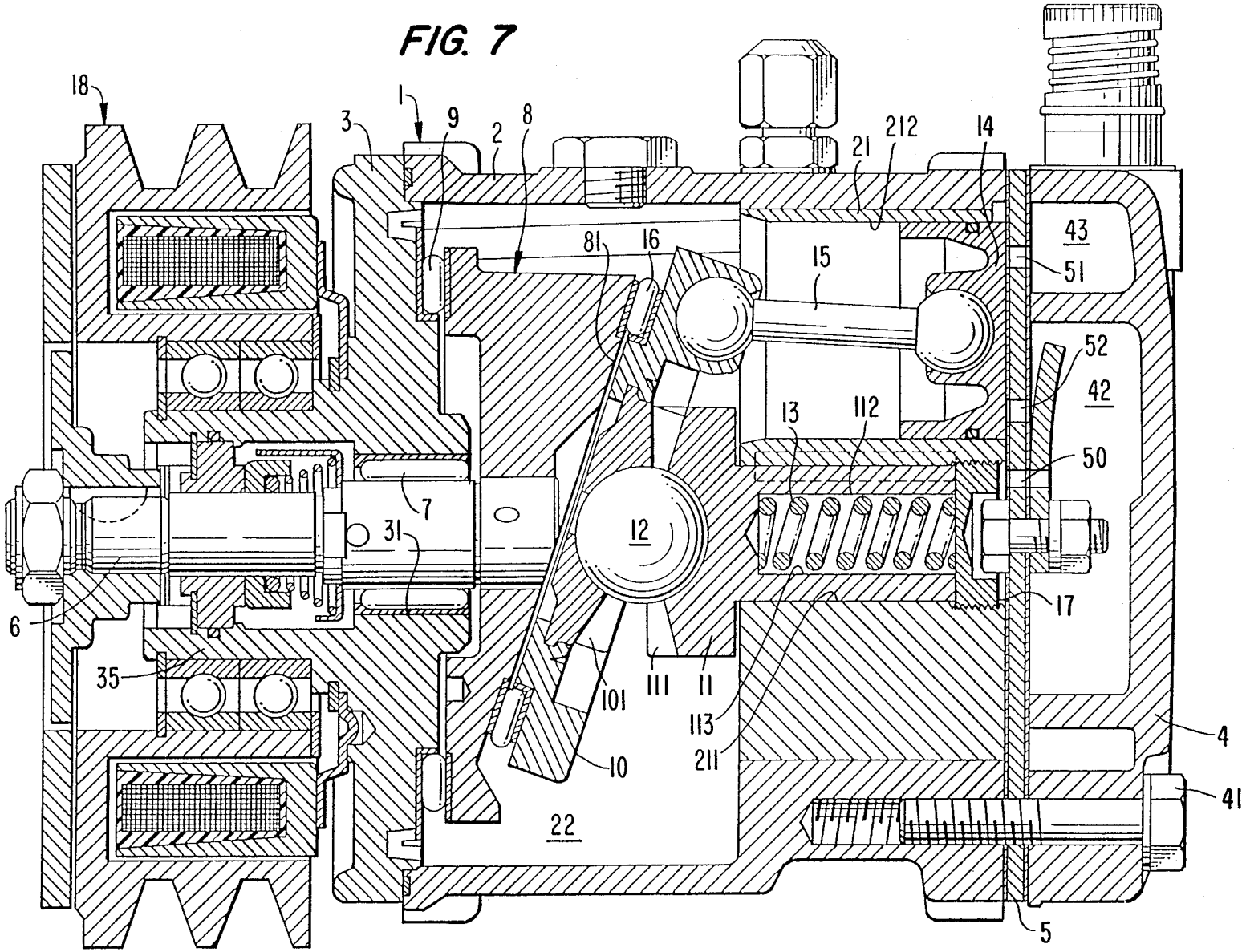
FIG. 7 is a cross-sectional view of a wobble plate type compressor according to another embodiment.

In addition, another embodiment of this invention which uses discharge gas pressure instead of coil spring 13 is shown in FIG. 7. A hole 50 is formed through valve plate 5 so that discharge chamber 42 communicates with central bore 211 of cylinder block 21. Discharged gas flows into central bore 211, passes through a gap between adjusting screw 17 and central bore 211, and acts on supporting member 1. Therefore, the axial end surface of cam rotor 8 is urged toward thrust bearing 9 by the recoil strength of coil spring 13 as well as gas pressure of discharged gas.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. In a wobble plate type compressor including a compressor housing having a plurality of cylinders and a crank chamber adjacent said cylinders therein, a reciprocative piston slidably fitted within each of said cylinders, a front end plate with a central opening attached to one end surface of said compressor housing, a drive mechanism coupled to said pistons to reciprocate said pistons within said cylinders, said drive mechanism including a drive shaft and a wedge-shaped cam rotor attached to said drive shaft, wherein said drive shaft is rotatably supported within said central opening of said front end plate by a radial bearing and said cam rotor is rotatably supported on an inner end surface of said compressor housing through a thrust bearing, a wobble plate mounted on a supporting member coupled to said cam rotor and said pistons for converting rotational motion of said cam rotor to reciprocating motion of said pistons, and an urging mechanism coupled to said wobble plate, the improvement comprising: said drive shaft being connected to said cam rotor at a predetermined angle $\theta_1$ therewith, said angle $\theta_1$ having a value greater than or equal to $\tan^{-1}(c/l)$, wherein 1 is the length of said radial bearing in the axial direction, and c is the clearance between the interior surface of said radial bearing and the exterior surface of the drive shaft, and wherein the force of said urging mechanism causes the inner end surface of said cam rotor to uniformly contact said thrust bearing.

2. The wobble plate type compressor according to claim 1 wherein said urging mechanism comprises a coil spring having a recoil strength greater than the forces at the connecting portion of said drive shaft and said cam rotor.

3. The wobble plate type compressor according to claim 1 wherein said urging mechanism comprises an opening communicating between a discharge chamber and said compressor housing, wherein discharged fluid passes from said discharge chamber into said compressor housing to force said wobble plate toward said cam rotor.

* * * * *

UNITED STATES PATENT AND TRADEMARK OFFICE

CERTIFICATE OF CORRECTION

PATENT NO. : 4,869,154

DATED : September 26, 1989

INVENTOR(S) : Hareo Takahashi, Kiyoshi Terauchi, Hideharu Hatakeyama and Shuzo Kumagai

It is certified that error appears in the above—identified patent and that said Letters Patent is hereby corrected as shown below:

**In the front title page, "Date of Patent: * September 26, 1989", should read --Date of Patent: September 26, 1989--.**

**In the front title page, in the Notice section, delete "[*] Notice: The portion of the term of this patent subsequent to October 3, 2006 has been disclaimed."**

Signed and Sealed this

Twenty-ninth Day of October, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,869,154

DATED : September 26, 1989

INVENTOR(S) : TAKAHASHI, Hareo; TERAUCHI, Kiyoshi; HATAKEYAMA, Hideharu; and KUMAGAI, Shuzo

It is certified that error appears in the above-identified patent and that said Letters Patent is hereby corrected as shown below:

Col. 1, line 50, change "Support" to --Supporting--.

Col. 2, line 67, after "acting" insert --on--.

Col. 7, line 18, change "1" to --11--.

Signed and Sealed this

Thirteenth Day of July, 1993

*Attest:*

Michael K. Kirk

MICHAEL K. KIRK

*Attesting Officer*

*Acting Commissioner of Patents and Trademarks*